US011047663B1

(12) United States Patent
Burrow

(10) Patent No.: US 11,047,663 B1
(45) **Date of Patent: *Jun. 29, 2021**

(54) METHOD OF CODING POLYMER AMMUNITION CARTRIDGES

(71) Applicant: TRUE VELOCITY IP HOLDINGS, LLC, Garland, TX (US)

(72) Inventor: Lonnie Burrow, Carrollton, TX (US)

(73) Assignee: TRUE VELOCITY IP HOLDINGS, LLC, Garland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/721,861

(22) Filed: Sep. 30, 2017

Related U.S. Application Data

(60) Continuation-in-part of application No. 14/724,240, filed on May 28, 2015, now Pat. No. 9,927,219, which is a division of application No. 14/011,202, filed on Aug. 27, 2013, now Pat. No. 9,546,849, which is a division of application No. 13/292,843, filed on Nov. 9, 2011, now Pat. No. 8,561,543.

(Continued)

(51) Int. Cl.

| | |
|---|---|
| ***F42B 33/00*** | (2006.01) |
| ***F42B 5/313*** | (2006.01) |
| ***F42B 5/297*** | (2006.01) |
| *F42B 5/02* | (2006.01) |

(52) U.S. Cl.
CPC ..... *F42B 33/001* (2013.01); *F42B 5/297* (2013.01); *F42B 5/313* (2013.01); *F42B 5/025* (2013.01)

(58) Field of Classification Search
CPC ..... F42B 33/001; F42B 5/297; F42B 5/313; F42B 5/025
USPC ..... 102/464, 466, 467; 86/10
See application file for complete search history.

(56) References Cited

U.S. PATENT DOCUMENTS

| | | | |
|---|---|---|---|
| 99,528 | A | 2/1870 | Boyd |
| 113,634 | A | 4/1871 | Crispin |

(Continued)

FOREIGN PATENT DOCUMENTS

| | | | |
|---|---|---|---|
| CA | 2813634 | A1 | 4/2012 |
| DE | 16742 | C | 1/1882 |

(Continued)

OTHER PUBLICATIONS

AccurateShooter.com Daily Bulletin "New PolyCase Ammunition and Injection-Molded Bullets" Jan. 11, 2015.

(Continued)

*Primary Examiner* — John Cooper

(74) *Attorney, Agent, or Firm* — Singleton Law, PLLC; Chainey P. Singleton

(57) ABSTRACT

The present invention provides a method of coding polymer ammunition cartridges by providing a first colored polymer forming a polymeric bullet-end upper portion comprising a bullet-end coupling element extending to a bullet-end aperture to engage a bullet; providing a second colored polymer forming a polymeric middle body comprising a first coupling end connected to the bullet-end coupling element and a second coupling end connected to a primer insert to form a propellant chamber that connects the bullet-end aperture to the primer insert; and coding the first colored polymer, the second colored polymer or both to identify a projectile type, an ammunition type, a propellant charge, or a combination thereof.

19 Claims, 5 Drawing Sheets

Related U.S. Application Data

(60) Provisional application No. 61/456,664, filed on Nov. 10, 2010.

(56) References Cited

U.S. PATENT DOCUMENTS 130,679 A 8/1872 Whitmore
159,665 A 2/1875 Gauthey
169,807 A 11/1875 Hart
462,611 A 11/1891 Comte de Sparre
498,856 A 6/1893 Overbaugh
640,856 A 1/1900 Bailey
662,137 A 11/1900 Tellerson
676,000 A 6/1901 Henneberg
865,979 A 9/1907 Bailey
869,046 A 10/1907 Bailey
905,358 A 12/1908 Peters
957,171 A 5/1910 Loeb
963,911 A 7/1910 Loeble
1,060,817 A 5/1913 Clyne
1,936,905 A 11/1933 Gaidos
1,940,657 A 12/1933 Woodford
2,294,822 A 9/1942 Norman
2,465,962 A 3/1949 Allen et al.
2,654,319 A 10/1953 Roske
2,823,611 A 2/1958 Thayer
2,862,446 A 12/1958 Lars
2,918,868 A 12/1959 Lars
2,953,990 A * 9/1960 Miller ..... F42B 7/06 102/449
2,972,947 A * 2/1961 Fitzsimmons ..... F42B 5/295 102/465
3,099,958 A 8/1963 Daubenspeck et al.
3,159,701 A 12/1964 Herter
3,170,401 A 2/1965 Johnson et al.
3,171,350 A 3/1965 Metcalf et al.
3,242,789 A 3/1966 Woodring
3,292,538 A 12/1966 Hans et al.
3,485,170 A 12/1969 Scanlon
3,485,173 A 12/1969 Morgan
3,609,904 A 10/1971 Scanlon
3,659,528 A 5/1972 Santala
3,688,699 A 9/1972 Horn et al.
3,690,256 A 9/1972 Schnitzer
3,745,924 A 7/1973 Scanlon
3,749,021 A 7/1973 Burgess
3,756,156 A 9/1973 Schuster
3,765,297 A 10/1973 Skochko et al.
3,768,413 A 10/1973 Ramsay
3,797,396 A 3/1974 Reed
3,842,739 A * 10/1974 Scanlon ..... F42B 5/073 102/467
3,866,536 A 2/1975 Greenberg
3,874,294 A * 4/1975 Hale ..... F42B 33/001 102/467
3,955,506 A * 5/1976 Luther ..... F42B 5/307 102/467
3,977,326 A * 8/1976 Anderson ..... F42B 5/307 102/467
3,990,366 A * 11/1976 Scanlon ..... F42B 5/26 102/467
4,020,763 A 5/1977 Iruretagoyena
4,147,107 A 4/1979 Ringdal
4,157,684 A 6/1979 Clausser
4,173,186 A 11/1979 Dunham
4,187,271 A 2/1980 Rolston et al.
4,228,724 A 10/1980 Leich
4,475,435 A 10/1984 Mantel
4,598,445 A 7/1986 O'Connor
4,614,157 A 9/1986 Grelle et al.
4,679,505 A 7/1987 Reed
4,694,752 A * 9/1987 Titus ..... F42C 11/06 102/215
4,718,348 A 1/1988 Ferrigno
4,719,859 A 1/1988 Ballreich et al.
4,726,296 A 2/1988 Leshner et al.
4,867,065 A 9/1989 Kaltmann et al.
5,021,206 A 6/1991 Stoops
5,033,386 A 7/1991 Vatsvog
5,063,853 A 11/1991 Bilgeri
5,090,327 A 2/1992 Bilgeri
5,151,555 A 9/1992 Vatsvog
5,165,040 A 11/1992 Andersson et al.
5,237,930 A 8/1993 Belanger et al.
5,247,888 A 9/1993 Conil
5,259,288 A 11/1993 Vatsvog
5,265,540 A 11/1993 Ducros et al.
5,433,148 A 7/1995 Barratault et al.
5,535,495 A 7/1996 Gutowski
5,563,365 A 10/1996 Dineen et al.
5,750,918 A * 5/1998 Mangolds ..... F41H 13/0006 102/213
5,770,815 A 6/1998 Watson
5,798,478 A 8/1998 Beal
5,814,755 A * 9/1998 Boss ..... F42C 17/04 89/6.5
5,827,958 A * 10/1998 Sigler ..... F42C 17/04 73/167
5,834,675 A * 11/1998 Boss ..... F42C 17/04 89/6.5
5,950,063 A 9/1999 Hens et al.
5,961,200 A 10/1999 Friis
5,969,288 A 10/1999 Baud
6,004,682 A 12/1999 Rackovan et al.
6,048,379 A 4/2000 Bray et al.
6,070,532 A 6/2000 Halverson
6,216,595 B1 * 4/2001 Lamorlette ..... F41G 7/30 102/200
6,272,993 B1 8/2001 Cook et al.
6,283,035 B1 9/2001 Olson et al.
6,310,335 B1 * 10/2001 Bonnet ..... F42B 10/50 244/3.1
6,345,785 B1 * 2/2002 Harkins ..... F42B 10/48 244/3.1
6,357,357 B1 3/2002 Glasser
6,375,971 B1 4/2002 Hansen
6,427,598 B1 * 8/2002 Boss ..... F42C 17/04 102/264
6,450,099 B1 9/2002 Desgland
6,460,464 B1 10/2002 Attarwala
6,484,115 B1 * 11/2002 Freymond ..... F42C 11/065 702/104
6,523,476 B1 2/2003 Riess et al.
6,649,095 B2 11/2003 Buja
6,672,219 B2 1/2004 Mackerell et al.
6,708,621 B1 3/2004 Forichon-Chaumet et al.
6,752,084 B1 6/2004 Husseini et al.
6,810,816 B2 11/2004 Rennard
6,840,149 B2 1/2005 Beal
6,845,716 B2 * 1/2005 Husseini ..... F42B 5/307 102/466
6,959,893 B1 * 11/2005 Sadowski ..... F42B 10/64 102/305
7,000,547 B2 2/2006 Amick
7,014,284 B2 3/2006 Morton et al.
7,032,492 B2 4/2006 Meshirer
7,056,091 B2 6/2006 Powers
7,059,234 B2 6/2006 Husseini
7,165,496 B2 1/2007 Reynolds
7,204,191 B2 * 4/2007 Wiley ..... B29C 65/02 102/517
7,213,519 B2 * 5/2007 Wiley ..... B29C 65/02 102/464
7,231,519 B2 * 6/2007 Joseph ..... H04L 9/0894 713/171
7,232,473 B2 6/2007 Elliott
7,249,730 B1 * 7/2007 Flippen, Jr. ..... F41G 7/346 244/3.1
7,299,750 B2 11/2007 Schikora et al.
7,353,756 B2 4/2008 Leasure
7,380,505 B1 6/2008 Shiery
7,383,776 B2 6/2008 Amick
7,392,746 B2 7/2008 Hansen

(56) References Cited

U.S. PATENT DOCUMENTS 7,441,504 B2 * 10/2008 Husseini ..... F42B 5/30 102/466
7,461,597 B2 12/2008 Brunn
7,585,166 B2 9/2009 Buja
7,610,858 B2 * 11/2009 Chung ..... F42B 5/313 102/466
7,750,091 B2 7/2010 Maljkovic et al.
7,841,279 B2 11/2010 Reynolds et al.
7,930,977 B2 4/2011 Klein
8,007,370 B2 8/2011 Hirsch et al.
8,056,232 B2 11/2011 Patel et al.
8,156,870 B2 4/2012 South
8,201,867 B2 6/2012 Thomeczek
8,206,522 B2 6/2012 Sandstrom et al.
8,240,252 B2 8/2012 Maljkovic et al.
8,408,137 B2 4/2013 Battaglia
8,443,729 B2 5/2013 Mittelstaedt
8,443,730 B2 * 5/2013 Padgett ..... F42C 19/10 102/466
8,511,233 B2 8/2013 Nilsson
8,522,684 B2 9/2013 Davies et al.
8,540,828 B2 9/2013 Busky et al.
8,561,543 B2 10/2013 Burrow
8,573,126 B2 11/2013 Klein et al.
8,641,842 B2 2/2014 Hafner et al.
8,689,696 B1 4/2014 Seeman et al.
8,763,535 B2 7/2014 Padgett
8,790,455 B2 7/2014 Borissov et al.
8,807,008 B2 8/2014 Padgett et al.
8,813,650 B2 8/2014 Maljkovic et al.
D715,888 S 10/2014 Padgett
8,850,985 B2 10/2014 Maljkovic et al.
8,857,343 B2 10/2014 Marx
8,869,702 B2 10/2014 Padgett
8,875,633 B2 11/2014 Padgett
8,893,621 B1 11/2014 Escobar
8,978,559 B2 3/2015 Davies et al.
9,003,973 B1 4/2015 Padgett
9,032,855 B1 * 5/2015 Foren ..... F42B 5/30 86/19.5
9,091,516 B2 7/2015 Davies et al.
9,103,641 B2 8/2015 Nielson et al.
9,157,709 B2 10/2015 Nuetzman et al.
9,170,080 B2 10/2015 Poore et al.
9,182,204 B2 * 11/2015 Maljkovic ..... F42B 5/26
9,188,412 B2 * 11/2015 Maljkovic ..... F42B 5/30
9,200,157 B2 12/2015 El-Hibri et al.
9,200,880 B1 12/2015 Foren et al.
9,212,876 B1 12/2015 Kostka et al.
9,212,879 B2 12/2015 Whitworth
9,213,175 B2 12/2015 Arnold
9,254,503 B2 2/2016 Ward
9,255,775 B1 2/2016 Rubin
9,329,004 B2 5/2016 Pace
9,335,137 B2 * 5/2016 Maljkovic ..... F42B 5/307
9,337,278 B1 5/2016 Gu et al.
9,347,457 B2 5/2016 Ahrens et al.
9,366,512 B2 6/2016 Burczynski et al.
9,377,278 B2 6/2016 Rubin
9,389,052 B2 7/2016 Conroy et al.
9,395,165 B2 * 7/2016 Maljkovic ..... F42B 5/34
D764,624 S 8/2016 Masinelli
D765,214 S 8/2016 Padgett
9,429,407 B2 * 8/2016 Burrow ..... C22C 33/0257
9,441,930 B2 * 9/2016 Burrow ..... F42C 19/0823
9,453,714 B2 * 9/2016 Bosarge ..... F42B 33/0207
9,500,453 B2 11/2016 Schluckebier et al.
9,506,735 B1 * 11/2016 Burrow ..... F42B 5/313
9,513,096 B2 * 12/2016 Burrow ..... C22C 38/44
9,518,810 B1 * 12/2016 Burrow ..... F42B 5/307
9,523,563 B1 * 12/2016 Burrow ..... F42C 19/08
9,528,799 B2 * 12/2016 Maljkovic ..... F42B 5/025
9,546,849 B2 * 1/2017 Burrow ..... C22C 38/02
9,551,557 B1 * 1/2017 Burrow ..... F42B 5/30
D778,391 S 2/2017 Burrow
D778,393 S 2/2017 Burrow
D778,394 S 2/2017 Burrow
D778,395 S 2/2017 Burrow
D779,024 S 2/2017 Burrow
9,587,918 B1 * 3/2017 Burrow ..... F42B 12/78
9,599,443 B2 3/2017 Padgett et al.
9,625,241 B2 4/2017 Neugebauer
9,631,907 B2 * 4/2017 Burrow ..... F42B 5/025
9,644,930 B1 * 5/2017 Burrow ..... F42B 5/307
9,658,042 B2 5/2017 Emary
9,683,818 B2 * 6/2017 Lemke ..... F42B 5/307
9,709,368 B2 7/2017 Mahnke
9,759,554 B2 9/2017 Ng et al.
9,784,667 B2 10/2017 Lukay et al.
9,835,423 B2 * 12/2017 Burrow ..... C22C 38/44
9,835,427 B2 * 12/2017 Burrow ..... F42B 5/313
9,857,151 B2 1/2018 Dionne et al.
9,869,536 B2 * 1/2018 Burrow ..... F42B 5/36
9,885,551 B2 * 2/2018 Burrow ..... F42B 5/26
9,921,040 B2 3/2018 Rubin
9,927,219 B2 * 3/2018 Burrow ..... C22C 38/58
9,933,241 B2 * 4/2018 Burrow ..... F42B 33/001
9,939,236 B2 * 4/2018 Drobockyi ..... F42B 33/001
9,964,388 B1 * 5/2018 Burrow ..... F42B 5/313
9,976,840 B1 * 5/2018 Burrow ..... F42B 5/313
10,041,770 B2 * 8/2018 Burrow ..... F42B 5/285
10,041,777 B1 * 8/2018 Burrow ..... F42B 5/307
10,048,049 B2 * 8/2018 Burrow ..... F42B 5/26
10,048,050 B1 * 8/2018 Burrow ..... F42B 5/30
10,048,052 B2 * 8/2018 Burrow ..... F42B 33/001
10,054,413 B1 * 8/2018 Burrow ..... F42B 5/307
D828,483 S * 9/2018 Burrow ..... F42B 5/30 D22/115
10,081,057 B2 * 9/2018 Burrow ..... B22F 1/0062
10,101,136 B2 * 10/2018 Burrow ..... F42C 19/083
10,101,140 B2 * 10/2018 Burrow ..... F42C 19/083
10,113,846 B2 * 10/2018 Pitre ..... F42B 5/28
D836,180 S * 12/2018 Burrow ..... B22F 3/004 D22/116
10,145,662 B2 * 12/2018 Burrow ..... F42B 33/02
10,190,857 B2 * 1/2019 Burrow ..... F42B 5/16
10,209,042 B2 * 2/2019 Baxter ..... F42B 33/001
10,234,249 B2 * 3/2019 Burrow ..... F42B 5/307
10,234,253 B2 * 3/2019 Burrow ..... C22C 38/02
10,240,905 B2 * 3/2019 Burrow ..... C22C 33/0257
10,254,096 B2 * 4/2019 Burrow ..... F42B 5/025
10,260,847 B2 * 4/2019 Viggiano ..... F42B 33/04
10,274,293 B2 * 4/2019 Burrow ..... B22F 5/06
D849,181 S * 5/2019 Burrow ..... C22C 38/18 D22/115
10,302,403 B2 * 5/2019 Burrow ..... F42B 5/307
10,302,404 B2 * 5/2019 Burrow ..... F42C 19/083
10,345,088 B2 * 7/2019 Burrow ..... C22C 38/02
10,352,664 B2 * 7/2019 Burrow ..... B22F 3/225
10,352,670 B2 * 7/2019 Burrow ..... B22F 3/225
10,359,262 B2 * 7/2019 Burrow ..... B22F 5/06
10,365,074 B2 * 7/2019 Burrow ..... F42C 19/08
D861,119 S * 9/2019 Burrow ..... C22C 38/18 D22/116
10,408,582 B2 * 9/2019 Burrow ..... F42B 5/307
10,408,592 B2 * 9/2019 Boss ..... C04B 35/64
10,415,943 B2 * 9/2019 Burrow ..... F42B 5/307
10,429,156 B2 * 10/2019 Burrow ..... F42B 5/307
10,458,762 B2 * 10/2019 Burrow ..... B22F 3/225
10,466,020 B2 * 11/2019 Burrow ..... C22C 38/44
10,466,021 B2 * 11/2019 Burrow ..... F42B 5/02
10,466,022 B2 * 11/2019 Peterson ..... F42B 8/02
10,480,911 B2 * 11/2019 Burrow ..... F42B 5/307
10,480,912 B2 * 11/2019 Burrow ..... C22C 38/02
10,480,915 B2 * 11/2019 Burrow ..... F42B 5/307
10,488,165 B2 * 11/2019 Burrow ..... C22C 38/44
10,527,425 B1 * 1/2020 Jankowski ..... G01C 21/16
10,533,830 B2 * 1/2020 Burrow ..... F42B 5/00
10,571,228 B2 * 2/2020 Burrow ..... F42C 19/0807
10,571,229 B2 * 2/2020 Burrow ..... F42B 5/02
10,571,230 B2 * 2/2020 Burrow ..... B22F 3/004
10,571,231 B2 * 2/2020 Burrow ..... B22F 5/06
10,578,409 B2 * 3/2020 Burrow ..... F42B 5/30
10,591,260 B2 * 3/2020 Burrow ..... F42C 19/083

(56) References Cited

U.S. PATENT DOCUMENTS

| | | | | |
|---|---|---|---|---|
| 10,612,896 | B2 * | 4/2020 | Burrow | B29C 45/0046 |
| 10,612,897 | B2 * | 4/2020 | Burrow | F42B 5/02 |
| 10,677,573 | B2 * | 6/2020 | Burrow | F42B 5/307 |
| 10,704,869 | B2 * | 7/2020 | Burrow | F42C 19/083 |
| 10,704,870 | B2 * | 7/2020 | Burrow | F42B 5/00 |
| 10,704,871 | B2 * | 7/2020 | Burrow | F42B 5/313 |
| 10,704,872 | B1 * | 7/2020 | Burrow | F42B 5/313 |
| 10,704,876 | B2 * | 7/2020 | Boss | F42B 5/02 |
| 10,704,877 | B2 * | 7/2020 | Boss | F42B 5/30 |
| 10,704,878 | B2 * | 7/2020 | Boss | C22C 38/18 |
| 10,704,879 | B1 * | 7/2020 | Burrow | F42B 5/307 |
| 10,704,880 | B1 * | 7/2020 | Burrow | F42C 19/083 |
| 10,731,956 | B2 * | 8/2020 | Burrow | F42B 5/02 |
| 10,731,957 | B1 * | 8/2020 | Burrow | F42B 5/307 |
| 10,753,713 | B2 * | 8/2020 | Burrow | F42B 5/30 |
| 2003/0127011 | A1 * | 7/2003 | Mackerell | F42B 5/295 102/464 |
| 2003/0131751 | A1 | 7/2003 | Mackerell et al. | |
| 2006/0027125 | A1 * | 2/2006 | Brunn | F42B 7/12 102/464 |
| 2006/0260500 | A1 | 11/2006 | Engel et al. | |
| 2006/0278116 | A1 * | 12/2006 | Hunt | F42B 12/50 102/512 |
| 2007/0056343 | A1 | 3/2007 | Cremonesi | |
| 2007/0214993 | A1 * | 9/2007 | Cerovic | F41H 13/0025 102/502 |
| 2009/0314178 | A1 | 12/2009 | South | |
| 2010/0275804 | A1 * | 11/2010 | Trivette | F42B 7/06 102/448 |
| 2012/0011219 | A1 | 1/2012 | Zhang et al. | |
| 2012/0024183 | A1 * | 2/2012 | Klein | F42B 5/36 102/467 |
| 2012/0037029 | A1 * | 2/2012 | Klement | F42B 5/025 102/464 |
| 2012/0111219 | A1 * | 5/2012 | Burrow | F42C 19/083 102/467 |
| 2012/0180688 | A1 * | 7/2012 | Padgett | B29C 65/72 102/466 |
| 2012/0199033 | A1 | 8/2012 | Bybee et al. | |
| 2013/0014665 | A1 | 1/2013 | Maljkovic et al. | |
| 2013/0186294 | A1 * | 7/2013 | Davies | F42B 5/313 102/467 |
| 2014/0060372 | A1 * | 3/2014 | Padgett | F42B 5/30 102/466 |
| 2014/0260925 | A1 | 9/2014 | Beach et al. | |
| 2015/0226220 | A1 | 8/2015 | Bevington | |
| 2015/0241183 | A1 | 8/2015 | Padgett et al. | |
| 2015/0241184 | A1 | 8/2015 | Burrow | |
| 2015/0268020 | A1 * | 9/2015 | Emary | F42B 12/20 102/439 |
| 2016/0003589 | A1 | 1/2016 | Burrow | |
| 2016/0003590 | A1 | 1/2016 | Burrow | |
| 2016/0003593 | A1 | 1/2016 | Burrow | |
| 2016/0003594 | A1 | 1/2016 | Burrow | |
| 2016/0003595 | A1 | 1/2016 | Burrow | |
| 2016/0003596 | A1 | 1/2016 | Burrow | |
| 2016/0003597 | A1 | 1/2016 | Burrow | |
| 2016/0003601 | A1 | 1/2016 | Burrow | |
| 2016/0033241 | A1 | 2/2016 | Burrow | |
| 2016/0102030 | A1 | 4/2016 | Coffey et al. | |
| 2016/0209186 | A1 | 7/2016 | Hajjar | |
| 2016/0245626 | A1 | 8/2016 | Drieling et al. | |
| 2016/0349023 | A1 | 12/2016 | Burrow | |
| 2016/0349028 | A1 | 12/2016 | Burrow | |
| 2016/0356581 | A1 | 12/2016 | Burrow | |
| 2016/0356588 | A1 | 12/2016 | Burrow | |
| 2016/0377399 | A1 | 12/2016 | Burrow | |
| 2017/0080498 | A1 | 3/2017 | Burrow | |
| 2017/0082409 | A1 | 3/2017 | Burrow | |
| 2017/0082411 | A1 | 3/2017 | Burrow | |
| 2017/0089673 | A1 | 3/2017 | Burrow | |
| 2017/0089674 | A1 | 3/2017 | Burrow | |
| 2017/0089675 | A1 | 3/2017 | Burrow | |
| 2017/0089679 | A1 | 3/2017 | Burrow | |
| 2017/0261294 | A1 | 9/2017 | Riess | |
| 2018/0066925 | A1 | 3/2018 | Skowron et al. | |

FOREIGN PATENT DOCUMENTS

| | | | |
|---|---|---|---|
| EP | 2625486 | A4 | 8/2017 |
| FR | 1412414 | A | 10/1965 |
| GB | 783023 | A | 9/1957 |
| WO | 0034732 | | 6/2000 |
| WO | 2007014024 | A2 | 2/2007 |
| WO | 2012047615 | A1 | 4/2012 |
| WO | 2012097320 | A1 | 7/2012 |
| WO | 2012097317 | A3 | 11/2012 |
| WO | 2013070250 | A1 | 5/2013 |
| WO | 2013096848 | A1 | 6/2013 |
| WO | 2014062256 | A2 | 4/2014 |
| WO | 2016003817 | A1 | 1/2016 |

OTHER PUBLICATIONS

Korean Intellectual Property Office (ISA), International Search Report and Written Opinion for PCT/US2011/062781 dated Nov. 30, 2012, 16 pp.

Korean Intellectual Property Office (ISA), International Search Report and Written Opinion for PCT/US2015/038061 dated Sep. 21, 2015, 28 pages.

* cited by examiner

METHOD OF CODING POLYMER AMMUNITION CARTRIDGES

TECHNICAL FIELD OF THE INVENTION

The present invention relates in general to the field of ammunition, specifically to compositions of matter and methods of making and using polymeric ammunition cartridge casings having visual indicia thereon.

CROSS-REFERENCE TO RELATED APPLICATIONS

None.

STATEMENT OF FEDERALLY FUNDED RESEARCH

None.

INCORPORATION-BY-REFERENCE OF MATERIALS FILED ON COMPACT DISC

None.

BACKGROUND OF THE INVENTION

Without limiting the scope of the invention, its background is described in connection with lightweight polymer cartridge casing ammunition. Conventional ammunition cartridge casings for rifles and machine guns, as well as larger caliber weapons, are made from brass, which is heavy, expensive, and potentially hazardous. There exists a need for an affordable lighter weight replacement for brass ammunition cartridge cases that can increase mission performance and operational capabilities. Lightweight polymer cartridge casing ammunition must meet the reliability and performance standards of existing fielded ammunition and be interchangeable with brass cartridge casing ammunition in existing weaponry. Reliable cartridge casings manufacture requires uniformity (e.g., bullet seating, bullet-to-casing fit, casing strength, etc.) from one cartridge to the next in order to obtain consistent pressures within the casing during firing prior to bullet and casing separation to create uniformed ballistic performance. Plastic cartridge casings have been known for many years but have failed to provide satisfactory ammunition that could be produced in commercial quantities with sufficient safety, ballistic, handling characteristics, and survive physical and natural conditions to which it will be exposed during the ammunition's intended life cycle; however, these characteristics have not been achieved.

For example, U.S. patent application Ser. No. 11/160,682 discloses a base for a cartridge casing body for an ammunition article, the base having an ignition device; an attachment device at one end thereof, the attachment device being adapted to the base to a cartridge casing body; wherein the base is made from plastic, ceramic, or a composite material.

U.S. Pat. No. 7,610,858 discloses an ammunition cartridge assembled from a substantially cylindrical polymeric cartridge casing body defining a casing headspace with an open projectile-end and an end opposing the projectile-end, wherein the casing body has a substantially cylindrical injection molded polymeric bullet-end component with opposing first and second ends, the first end of which is the projectile-end of the casing body and the second end has a male or female coupling element; and a cylindrical polymeric middle body component with opposing first and second ends, wherein the first end has a coupling element that is a mate for the projectile-end coupling element and joins the first end of the middle body component to the second end of the bullet-end component, and the second end is the end of the casing body opposite the projectile end and has a male or female coupling element; and a cylindrical cartridge casing head-end component with an essentially closed base end with a primer hole opposite an open end with a coupling element that is a mate for the coupling element on the second end of the middle body and joins the second end of the middle body component to the open end of the head-end component; wherein the middle body component is formed from a material more ductile than the material head-end component is formed from but equal or less ductile than the material the bullet-end component is formed from. Methods for assembling ammunition cartridges and ammunition cartridges having the headspace length larger than the corresponding headspace length of the chamber of the intended weapon measured at the same basic diameter for the cartridge casing without being so large as to jam the weapon or otherwise interfere with its action are also disclosed.

BRIEF SUMMARY OF THE INVENTION

One embodiment of the present invention provides a method of coding polymer ammunition cartridges comprising the steps of: providing a first colored polymer forming a polymeric bullet-end upper portion comprising a bullet-end coupling element extending to a bullet-end aperture to engage a bullet; providing a second colored polymer forming a polymeric middle body comprising a first coupling end connected to the bullet-end coupling element and a second coupling end connected to a primer insert to form a propellant chamber that connects the bullet-end aperture to the primer insert; and coding the first colored polymer, the second colored polymer or both to identify a projectile type, an ammunition type, a propellant charge, or a combination thereof.

The first colored polymer comprises one or more pigments selected from black pigments, white pigments, gray pigments, pink pigments, red pigments, orange pigments, yellow pigments, green pigments, cyan pigments, blue pigments, violet pigments, purple pigments, brown pigments, tan pigments, brass pigments, copper pigments, or gold pigments. The second colored polymer comprises one or more pigments selected from black pigments, white pigments, gray pigments, pink pigments, red pigments, orange pigments, yellow pigments, green pigments, cyan pigments, blue pigments, violet pigments, purple pigments, brown pigments, tan pigments, brass pigments, copper pigments, or gold pigments. The first colored polymer comprises one or more first pigments selected from black pigments, white pigments, gray pigments, pink pigments, red pigments, orange pigments, yellow pigments, green pigments, cyan pigments, blue pigments, violet pigments, purple pigments, brown pigments, tan pigments, brass pigments, copper pigments, or gold pigments and the second colored polymer comprises one or more second pigments selected from black pigments, white pigments, gray pigments, pink pigments, red pigments, orange pigments, yellow pigments, green pigments, cyan pigments, blue pigments, violet pigments, purple pigments, brown pigments, tan pigments, brass pigments, copper pigments, or gold pigments. The one or more pigments may be present in an amount of between 0.001 and 10 wt % and more specifically 0.001 wt %, 0.01 wt %, 0.1 wt %, 0.25 wt %, 0.5 wt %, 0.75 wt %, 1 wt %, 2 wt %, 2.1 wt %, 2.25 wt %, 2.5 wt %, 2.75 wt %, 3.1 wt %, 3.25 wt %, 3.5 wt %, 3.75 wt %, 4.0 wt %, 4.25 wt %, 4.5 wt %, 4.75 wt %, 5.0 wt %, 5.25 wt %, 5.5 wt %, 5.75 wt %, 6.0 wt %, 6.25 wt %, 6.5 wt %, 6.75 wt %, 7.0 wt %, 7.25 wt %, 7.5 wt %, 7.75 wt %, 8.0 wt %, 8.25 wt %, 8.5 wt %, 8.75 wt %, 9.0 wt %, 9.25 wt %, 9.5 wt %, 9.75 wt %, 10.0 wt % and incremental variations thereof. The one or more first pigments and the one or more second pigments may be different pigments. The first colored polymer, the second colored polymer or both comprise polybutylene terephthalate, polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The polymeric bullet-end upper portion, the polymeric middle body or both comprise a nylon polymer or a polycarbonate polymer. The fiber-reinforced polymeric composite contains between about 3 and about 50 wt % glass fiber fillers, mineral fillers, or mixtures thereof. The ammunition cartridges is a 5.56 mm, 7.62 mm, 308, 338, 3030, 3006, 50 caliber, 45 caliber, 380 caliber, 38 caliber, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm, 460 mm, 8 inch, or 4.2 inch ammunition cartridge. The primer insert comprises a top surface opposite a bottom surface and an insert coupling element that extends from the bottom surface, a primer recess in the top surface that extends toward the bottom surface, a primer flash hole positioned in the primer recess to extend through the bottom surface, and a flange that extends circumferentially about an outer edge of the top surface.

The present invention also provides a method of coding polymer metal ammunition cartridges comprising the steps of: providing a first colored polymer forming a polymeric bullet-end upper portion comprising a bullet-end coupling element extending to a bullet-end aperture to engage a bullet; providing a metal middle body comprising a first coupling end connected to the bullet-end coupling element and a primer insert at a second end to define a propellant chamber that connects the bullet-end aperture to the primer insert; and coding the first colored polymer to identify a projectile type, an ammunition type, a propellant charge, or a combination thereof.

The first colored polymer comprises one or more pigments selected from black pigments, white pigments, gray pigments, pink pigments, red pigments, orange pigments, yellow pigments, green pigments, cyan pigments, blue pigments, violet pigments, purple pigments, brown pigments, tan pigments, brass pigments, copper pigments, or gold pigments. The first colored polymer comprises polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The metal middle body comprises stainless steel, brass, ceramic alloys, copper/cobalt/nickel/custom alloys, tungsten, tungsten carbide, carballoy, ferro-tungsten, titanium, copper, cobalt, nickel, uranium, depleted uranium, alumina oxide, zirconia and aluminum. The polymer metal ammunition cartridges is a 5.56 mm, 7.62 mm, 308, 338, 3030, 3006, 50 caliber, 45 caliber, 380 caliber, 38 caliber, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm, 460 mm, 8 inch, or 4.2 inch ammunition cartridge.

The present invention provides a method of coding metal polymer ammunition cartridges comprising the steps of: providing a metal bullet-end upper portion comprising a bullet-end coupling element extending to a bullet-end aperture to engage a bullet; providing a colored polymer forming a polymeric middle body comprising a first coupling end connected to the bullet-end coupling element and a second coupling end connected to a primer insert to form a propellant chamber that connects the bullet-end aperture to the primer insert; and coding the colored polymer to identify a projectile type, an ammunition type, a propellant charge, or a combination thereof.

The colored polymer comprises one or more pigments selected from black pigments, white pigments, gray pigments, pink pigments, red pigments, orange pigments, yellow pigments, green pigments, cyan pigments, blue pigments, violet pigments, purple pigments, brown pigments, tan pigments, brass pigments, copper pigments, or gold pigments. The colored polymer comprises polybutylene terephthalate, polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The metal middle body comprises stainless steel, brass, ceramic alloys, copper/cobalt/nickel/custom alloys, tungsten, tungsten carbide, carballoy, ferro-tungsten, titanium, copper, cobalt, nickel, uranium, depleted uranium, alumina oxide, zirconia and aluminum. The metal polymer ammunition cartridge is a 5.56 mm, 7.62 mm, 308, 338, 3030, 3006, 50 caliber, 45 caliber, 380 caliber, 38 caliber, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm, 460 mm, 8 inch, or 4.2 inch ammunition cartridge.

BRIEF DESCRIPTION OF THE SEVERAL VIEWS OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
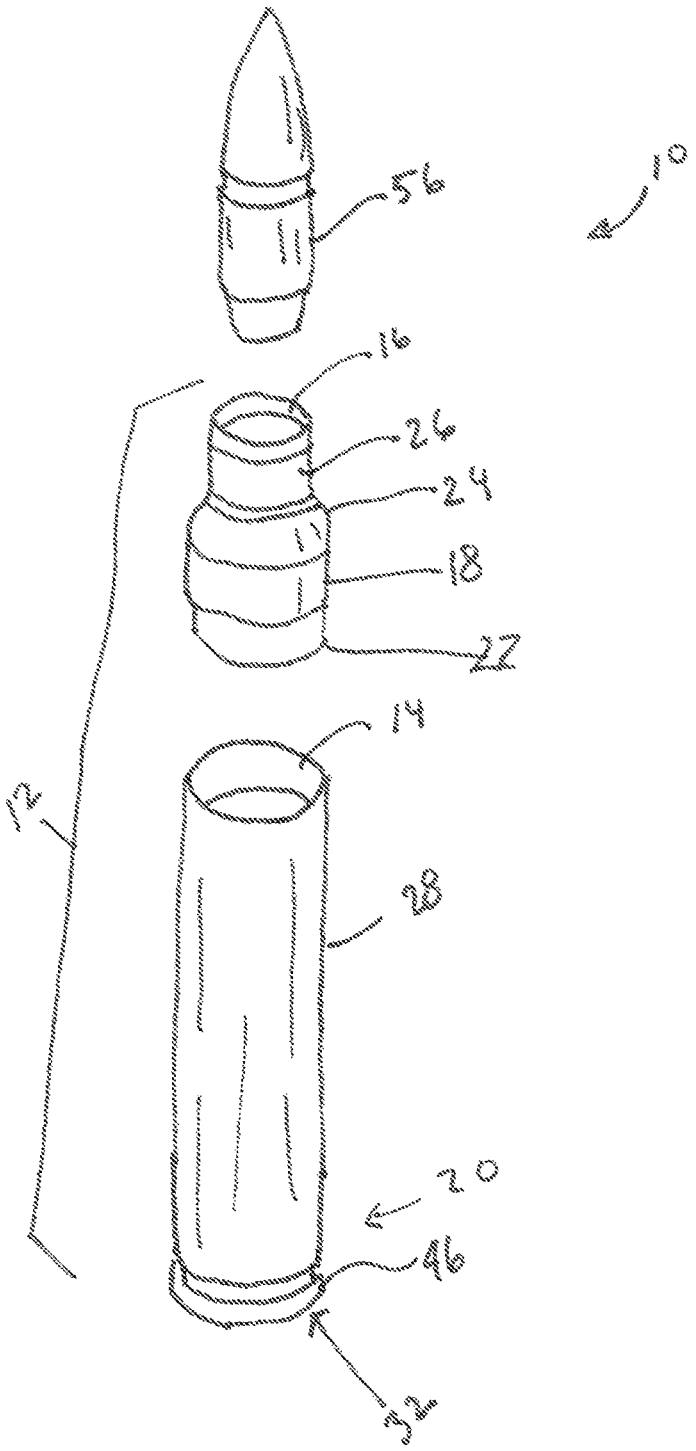
FIG. 1 depicts an exploded view of the polymeric cartridge casing.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

As used herein the term colorant is denotes pigment and dye are used interchangeably to denote a substance that provides a color to a material. Pigments and dyes are include compositions that is a powders, solutions or suspensions and may be added to a polymer, doped into the polymer, doped or mixed into a polymer that is then combined with a second (or more) polymer produce a specific color and polymer composition. The present invention provides the ability to mix various colors to produce the exact color desired and in fact allows the production of any color when the specific colors are combined in the correct proportions. In addition various dyes and pigments and glazes may be combined in numerous combinations to produce the specific desired color or colors. The dye chemical structures include nitroso, nitro, monoazo, diazo, stilbene, diarylmethane, triarylmethane, xanthene, acridine, quinoline, methine, thiazole, indamine, indophenol, azine, oxazine, thiazine, aminoketone, anthraquinone, indigoid, phthalocyanine, natural dyes, inorganic pigments and/or combinations thereof. Similarly the colors may be applied to produce a pattern (either specific e.g., stripes, lines, geometric, natural objects leaves, camo, etc. and/or a combination thereof.

Reliable cartridge manufacture requires uniformity from one cartridge to the next in order to obtain consistent ballistic performance. Among other considerations, proper bullet seating and bullet-to-casing fit is required. In this manner, a desired pressure develops within the casing during firing prior to bullet and casing separation. Historically, bullets employ a cannelure, which is a slight annular depression formed in a surface of the bullet at a location determined to be the optimal seating depth for the bullet. In this manner, a visual inspection of a cartridge could determine whether or not the bullet is seated at the proper depth. Once the bullet is inserted into the casing to the proper depth, one of two standard procedures is incorporated to lock the bullet in its proper location. One method is the crimping of the entire end of the casing into the cannelure. A second method does not crimp the casing end; rather the bullet is pressure fitted into the casing.

The polymeric ammunition cartridges of the present invention are of a caliber typically carried by soldiers in combat for use in their combat weapons. The present invention is not limited to the described caliber and is believed to be applicable to other calibers as well. This includes various small and medium caliber munitions, including 0.22, 0.22-250, 0.223, 0.243, 0.25-06, 0.270, 0.300, 0.30-30, 0.30-40, 30.06, 0.300, 0.303, 0.308, 0.338, 0.357, 0.38, 0.380, 0.40, 0.44, 0.45, 0.45-70, .50 BMG, caliber ammunition cartridges, as well as medium/small caliber ammunition such as including 5.45 mm, 5.56 mm, 6.5 mm, 6.8 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm, 460 mm, 8 inch, 4.2 inch and the like and military style ammunition. Thus, the present invention is also applicable to the sporting goods industry for use by hunters and target shooters and military applications.

Figure 2:
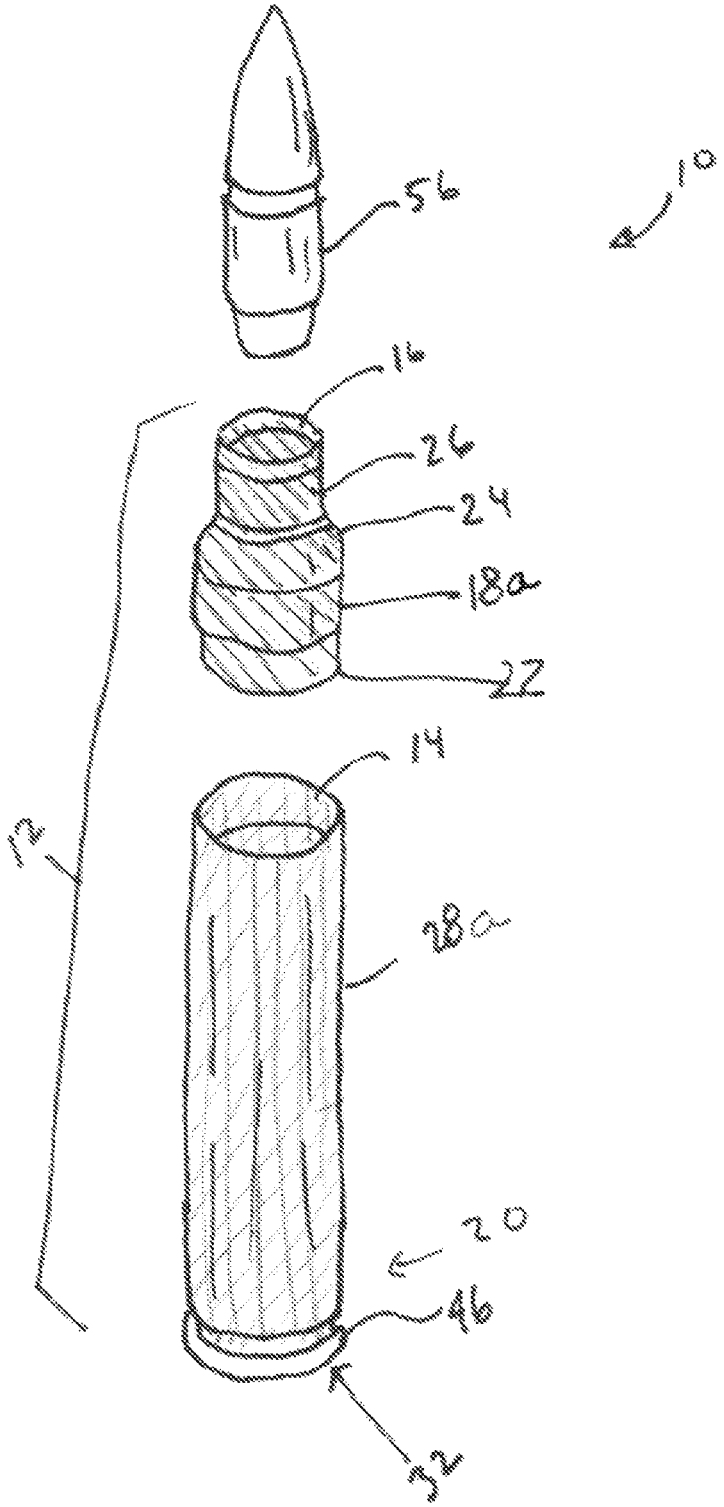
FIG. 2 depicts an exploded view of the colored polymeric cartridge casing.

FIGS. 1 and 2 depict an exploded view of the polymeric cartridge casing having an over-molded primer insert. A cartridge casing 10 suitable for use with rifles is shown manufactured with a casing 12 showing a propellant chamber 14 with a projectile 56 inserted into the forward end opening 16. The cartridge casing 12 has a substantially cylindrical open-ended bullet-end component 18 extending from the forward end opening 16 rearward to the opposite end 20. The forward end of bullet-end component 18 has a shoulder 24 forming a chamber neck 26. The bullet-end component 18 may be formed with coupling end 22 formed on substantially cylindrical opposite end 20 or formed as a separate component. These and other suitable methods for securing individual pieces of a two-piece or multi-piece cartridge casing are useful in the practice of the present invention. Coupling end 22 is shown as a male element, but may also be configured as a female element in alternate embodiments of the invention. In some embodiments the forward end of bullet-end component 18 includes the forward end opening 16 without a shoulder 24 forming chamber neck 26. The bullet-end component typically has a wall thickness between about 0.003 and about 0.200 inches and more preferably between about 0.005 and more preferably between about 0.150 inches about 0.010 and about 0.050 inches. The middle body component 28 is substantially cylindrical and connects the forward end of bullet-end component 18 to the substantially cylindrical opposite end 20 and forms the propellant chamber 14. The substantially cylindrical opposite end 20 includes a substantially cylindrical insert 32 that partially seals the propellant chamber 14. In a two piece design as shown in FIG. 1 the substantially cylindrical insert 32 is molded into the middle body component 28. The substantially cylindrical insert 32 includes a bottom surface (not shown) located in the propellant chamber 14 that is opposite a top surface (not shown). The substantially cylindrical insert 32 has a flange 46 and includes a primer recess (not shown) positioned in the top surface (not shown) extending toward the bottom surface (not shown) with a primer flash hole aperture (not shown) is located in the primer recess (not shown) and extends through the bottom surface (not shown) into the propellant chamber 14 to combust the propellant in the propellant chamber 14. A primer (not shown) is located in the primer recess (not shown) and extends through the bottom surface (not shown) into the propellant chamber 14. In some embodiments the coupling end 22 extends the polymer through the primer flash hole aperture (not shown) to form the primer flash hole (not shown) while retaining a passage from the top surface (not shown) through the bottom surface (not shown) and into the propellant chamber 14 to provide support and protection about the primer flash hole aperture (not shown). In other embodiments the coupling end 22 extends the polymer up to but not into the primer flash hole aperture (not shown) to form the primer flash hole (not shown) while retaining a passage from the top surface (not shown) through the bottom surface (not shown) and into the propellant chamber 14. The bullet-end 18, middle body 28 and bottom surface (not shown) define the interior of propellant chamber 14 in which the powder charge (not shown) is contained. The interior volume of propellant chamber 14 may be varied to provide the volume necessary for complete filling of the propellant chamber 14 by the propellant chosen so that a simplified volumetric measure of propellant can be utilized when loading the cartridge. The bullet-end and bullet components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature. An optional first and second annular grooves (cannelures) may be provided in the bullet-end in the interlock surface of the male coupling element to provide a snap-fit between the two components. The cannelures formed in a surface of the bullet at a location determined to be the optimal seating depth for the bullet. Once the bullet is inserted into the casing to the proper depth to lock the bullet in its proper location. One method is the crimping of the entire end of the casing into the cannelures. The bullet-end and middle body components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature.

FIG. 2 depicts an exploded view of a three piece polymeric cartridge casing showing the cartridge casing 10 having a first colored open-ended bullet-end component 18*a* and a second colored middle body component 28*a*. The first colored open-ended bullet-end component 18*a* and the second colored middle body component 28*a* may be the same color or different colors. In addition, within the first colored open-ended bullet-end component 18*a* and/or the second colored middle body component 28*a* there may be a color variation in shade, pigment, color, etc. The color of the first colored open-ended bullet-end component 18*a* and the second colored middle body component 28*a* are accomplished by the pigment and/or dye in the polymer composition itself.

Although FIGS. 1 and 2 describe a polymer cartridge, the present invention also applies to metal cartridges (e.g., made by metal injection molding, casting, machining, forging, 3-D printing, and any other mechanism used to make a cartridge) and hybrid cartridges that include a cartridge made from a combination of polymers and metal or any combination of polymers or copolymers and metals and/or alloys. The present invention may also be used in a traditional metal cartridge casing. The metal cartridge casing includes a metal casing having a propellant chamber with a forward end opening for insertion of a projectile. The forward end opening may include a shoulder forming chamber neck. The opposite end of the forward end opening in the metal cartridge casing includes a flange around the parameter and a primer recess with a primer flash aperture formed therein for ease of insertion of the primer (not shown). A primer flash hole aperture is located in the primer recess and extends into the propellant chamber to combust the propellant in the propellant chamber.

Figure 3:
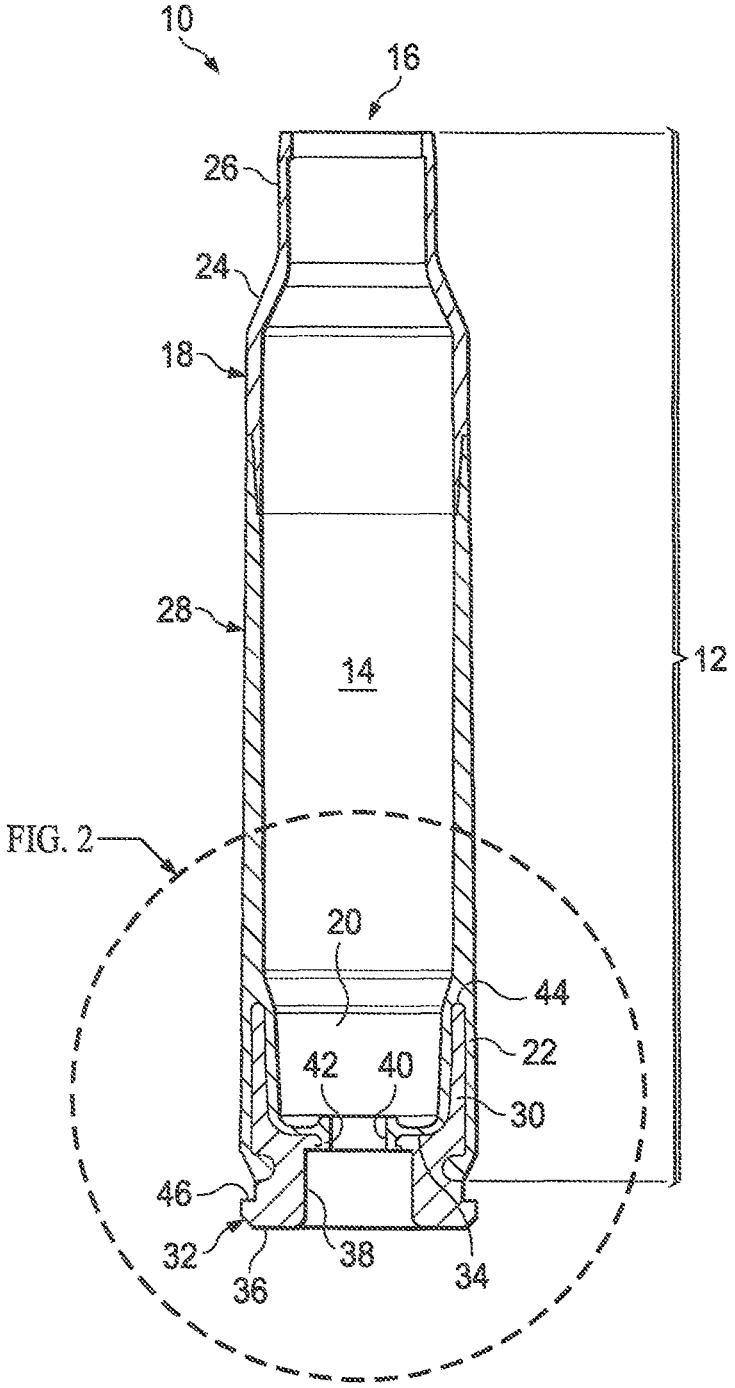
FIG. 3 depicts a side, cross-sectional view of a polymeric cartridge case.
Figure 4:
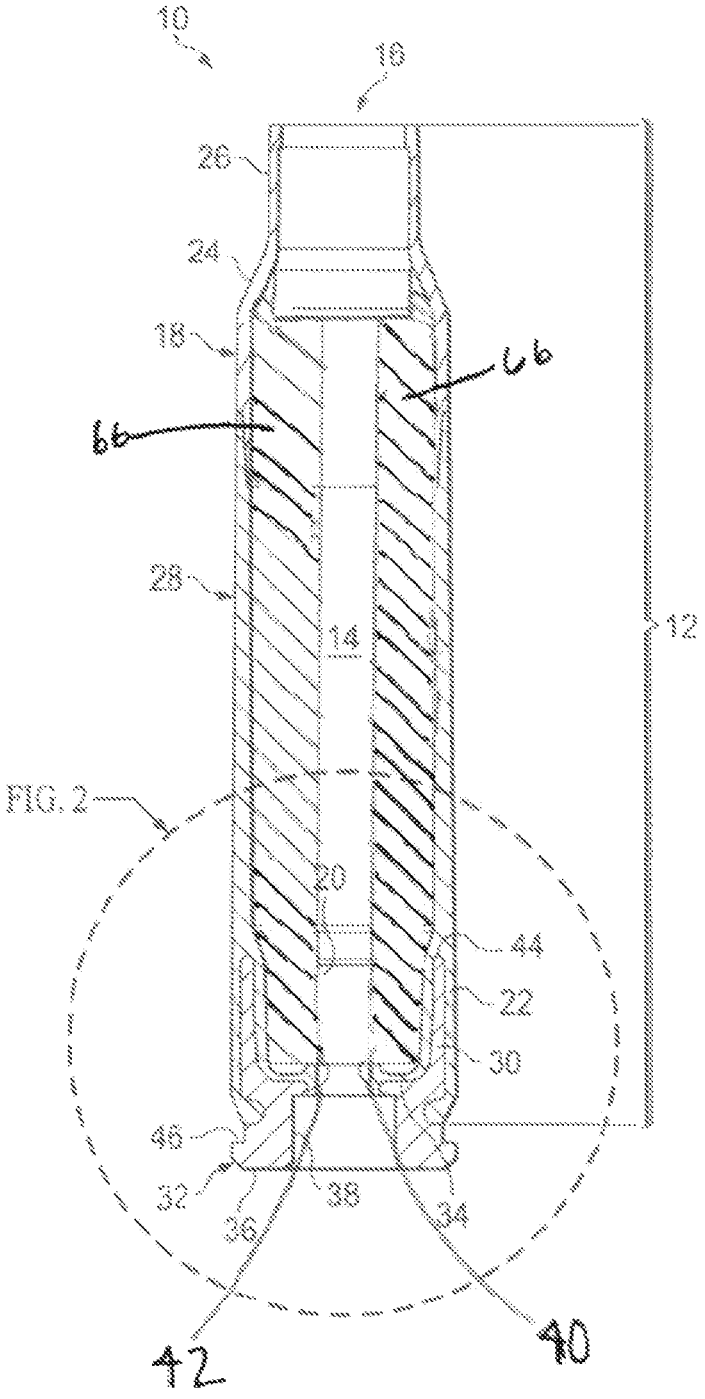
FIG. 4 depicts a side, cross-sectional view of a subsonic polymeric cartridge case.

FIGS. 3 and 4 depict a cross-sectional view of a standard polymeric cartridge case and a polymeric cartridge case having a subsonic insert. FIG. 3 depicts a side, cross-sectional view of a polymeric cartridge case. A cartridge casing 10 is shown with a casing 12 showing a propellant chamber 14 with a projectile (not shown) inserted into the forward end opening 16. The cartridge casing 12 has a substantially cylindrical open-ended bullet-end component 18 extending from the forward end opening 16 rearward to the opposite end 20. The forward end of bullet-end component 18 has a shoulder 24 forming a chamber neck 26. The bullet-end component 18 may be formed with coupling end 22 formed on substantially cylindrical opposite end 20 or formed as a separate component. These and other suitable methods for securing individual pieces of a two-piece or multi-piece cartridge casing are useful in the practice of the present invention. Coupling end 22 is shown as a female element, but may also be configured as a male element in alternate embodiments of the invention. The forward end of bullet-end component 18 has a shoulder 24 forming chamber neck 26. The bullet-end component typically has a wall thickness between about 0.003 and about 0.200 inches and more preferably between about 0.005 and more preferably between about 0.150 inches about 0.010 and about 0.050 inches. The middle body component 28 is substantially cylindrical and connects the forward end of bullet-end component 18 to the substantially cylindrical opposite end 20 and forms the propellant chamber 14. The substantially cylindrical opposite end 20 includes a substantially cylindrical insert 32 that partially seals the propellant chamber 14. The substantially cylindrical insert 32 also has a flange 46 cut therein and a primer recess 38 formed therein for ease of insertion of the primer (not shown). The primer recess 38 is sized so as to receive the primer (not shown) in a friction fit during assembly. The cartridge casing 12 may be molded from a polymer composition with the middle body component 28 being over-molded onto the substantially cylindrical insert 32. When over-molded the coupling end 22 extends the polymer through the primer flash hole aperture 42 to form the primer flash hole 40 while retaining a passage from the top surface 36 through the bottom surface 34 and into the propellant chamber 14 to provide support and protection about the primer flash hole aperture 42. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. The primer flash hole 40 communicates through the bottom surface 34 of substantially cylindrical insert 32 into the propellant chamber 14 so that upon detonation of primer (not shown) the propellant (not shown) in propellant chamber 14 will be ignited. The bullet-end component 18 and middle body component 28 can be welded or bonded together using solvent, adhesive, spin-welding, vibration-welding, ultrasonic-welding, or laser-welding techniques. Other possible securing methods include, but are not limited to, mechanical interlocking methods such as over molding, press-in, ribs and threads, adhesives, molding in place, heat crimping, ultrasonic welding, friction welding etc.

FIG. 4 depicts a cross-sectional view of a polymeric cartridge case having a reduced interior volume. A cartridge casing 10 suitable for use with high velocity rifles is shown manufactured with a casing 12 showing a propellant chamber 14 with a projectile (not shown) inserted into the forward end opening 16. The cartridge casing 12 has a substantially cylindrical open-ended bullet-end component 18 extending from the forward end opening 16 rearward to the opposite end 20. The forward end of bullet-end component 18 has a shoulder 24 forming a chamber neck 26. The bullet-end component 18 may be formed with coupling end 22 formed on substantially cylindrical opposite end 20 or formed as a separate component. These and other suitable methods for securing individual pieces of a two-piece or multi-piece cartridge casing are useful in the practice of the present invention. Coupling end 22 is shown as a female element, but may also be configured as a male element in alternate embodiments of the invention. The forward end of bullet-end component 18 has a shoulder 24 forming chamber neck 26. The bullet-end component typically has a wall thickness between about 0.003 and about 0.200 inches and more preferably between about 0.005 and more preferably between about 0.150 inches about 0.010 and about 0.050 inches. The middle body component 28 is substantially cylindrical and connects the forward end of bullet-end component 18 to the substantially cylindrical opposite end 20 and forms the propellant chamber 14. The substantially cylindrical opposite end 20 includes a substantially cylindrical insert 32 that partially seals the propellant chamber 14. The substantially cylindrical insert 32 includes a flange 46 and a bottom surface 34 located in the propellant chamber 14 that is opposite a top surface 36. The substantially cylindrical insert 32 includes a primer recess 38 positioned in the top surface 36 extending toward the bottom surface 34 with a primer flash hole aperture 42 is located in the primer recess 38 and extends through the bottom surface 34 into the propellant chamber 14 to combust the propellant in the propellant chamber 14. A primer (not shown) is located in the primer recess 38 and extends through the bottom surface 34 into the propellant chamber 14. When molded the coupling end 22 extends the polymer through the primer flash hole aperture 42 to form the primer flash hole 40 while retaining a passage from the top surface 36 through the bottom surface 34 and into the propellant chamber 14 to provide support and protection about the primer flash hole aperture 42. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. The bullet-end 18, middle body 28 and bottom surface 34 define the interior of propellant chamber 14 in which the powder charge (not shown) is contained. The interior volume of propellant chamber 14 may be varied to provide the volume necessary for complete filling of the propellant chamber 14 by the propellant chosen so that a simplified volumetric measure of propellant can be utilized when loading the cartridge. The propellant chamber 14 includes a propellant chamber insert 66 that extends from the bottom surface 34 to the shoulder 24. The thickness of the propellant chamber insert 66 may be defined as the distance from the propellant chamber 14 to the interior of the middle body component 28 and may be varied as necessary to achieve the desired velocity depending on the propellant used. The propellant chamber 14 includes a propellant chamber insert 66 that extends from the bottom surface 34 to the shoulder 24 at a graduated distance from the propellant chamber 14 to the interior of the middle body component 28. The bullet-end and bullet components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature. An optional first and second annular grooves (cannelures) may be provided in the bullet-end in the interlock surface of the male coupling element to provide a snap-fit between the two components. The cannelures formed in a surface of the bullet at a location determined to be the optimal seating depth for the bullet. Once the bullet is inserted into the casing to the proper depth to lock the bullet in its proper location. One method is the crimping of the entire end of the casing into the cannelures. The bullet-end and middle body components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature.

Figure 5:
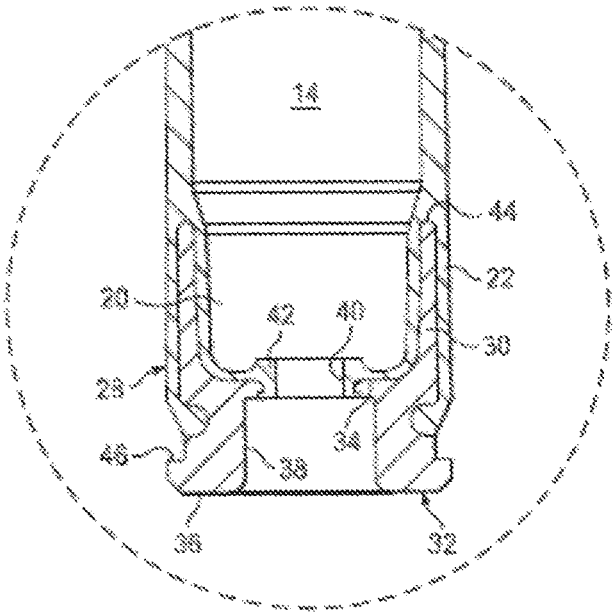
FIG. 5 depicts a side, cross-sectional view of a portion of the polymeric cartridge.
Figure 6:
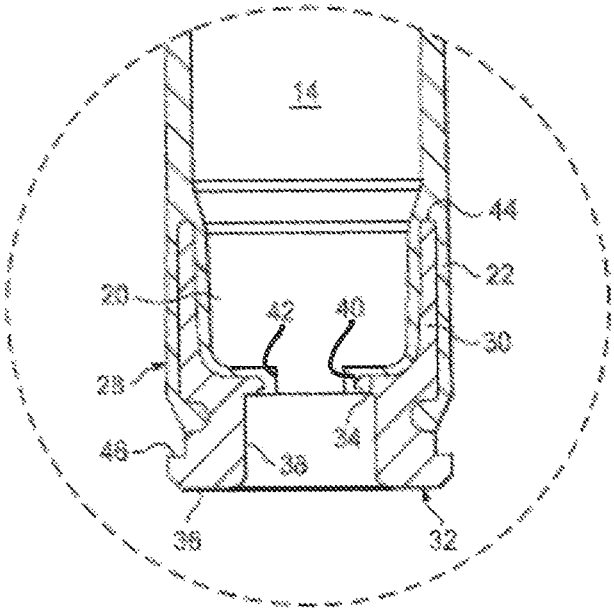
FIG. 6 depicts a side, cross-sectional view of a portion of the polymeric cartridge.

FIGS. 5 and 6 depict side, cross-sectional views of a portion of the polymeric cartridge case according to one embodiment of the present invention. A portion of a cartridge suitable for use with high velocity rifles is shown manufactured with a polymer casing 12 showing a powder chamber 14. Polymer casing 12 has a substantially cylindrical opposite end 20. The bullet-end component 18 may be formed with coupling end 22 formed on end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 28 and extends through the bottom surface 34 into the powder chamber 14. The coupling end 22 extends the polymer through the primer flash hole 40 to form an aperture coating 42 while retaining a passage from the top surface 36 through the bottom surface 34 and into the powder chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28.

The present invention includes cartridge casings that are made from polymeric materials or at least partially from a polymer material. In addition, the cartridge casings may be made of similar or dissimilar materials. For example, the cartridge casing may be entirely made of polymer materials or from a combination of polymer materials and metals or metal alloys. The cartridge casing may be made in multiple components that are assembled, e.g., the bullet-end component may be connected to the middle body component that includes a primer insert as in FIG. 1; the bullet-end component may be connected to the middle body component that is connected to a primer insert component as in FIG. 2; or the bullet-end component, the middle body component and the primer insert in a unitary body (not shown). The individual components of the cartridge casing may be made entirely of polymer materials and the polymer materials may be dissimilar polymers or similar polymers depending on the particular application. Similarly, the individual components of the cartridge casing may include metal or alloy components of dissimilar compositions or similar compositions depending on the particular application. As a result of the multicomponent structure of the cartridge casing and the multiple materials for forming each of the components, there are numerous possible combinations that can be used to form the ammunition and/or cartridge casing. Generally the present invention may be used in cartridges of any configuration provided at least a portion of the cartridges comprises a polymer. For example, a single piece cartridge has a unitary construction having a bullet-end component and middle body component being a single construction that overmolds a substantially cylindrical insert. In this unitary construction the single piece cartridge is made from a polymer.

For example, the bullet-end component may be made of a first polymer while the middle body component may be made from the same first polymer; the bullet-end component may be made of a first polymer while the middle body component may be made from a second polymer; the bullet-end component may be made of a first metal while the middle body component may be made from the same first metal; the bullet-end component may be made of a first metal while the middle body component may be made from a second metal; the bullet-end component may be made of a first alloy while the middle body component may be made from the same first alloy; the bullet-end component may be made of a first alloy while the middle body component may be made from a second alloy; the bullet-end component may be made of a first polymer while the middle body component may be made from a metal; the bullet-end component may be made of a first polymer while the middle body component may be made from an alloy; the bullet-end component may be made of a metal while the middle body component may be made from a polymer; or the bullet-end component may be made of an alloy while the middle body component may be made from a polymer. In these variations, the bullet-end component must be joined to the middle body component. This joining may be accomplished using a variety of methods in the art used to join similar and dissimilar materials. For example, the bullet-end component must be joined to the middle body component by brazing (e.g., furnace brazing, induction brazing, resistance brazing and hydrogen brazing); welding (e.g., electron beam welding, ultrasonic welding, laser welding, fusion welding, resistance welding (e.g., spot, seam, and flash welding), pressure welding and fusion welding); soldering; and adhesive bonding. In addition the bullet-end component may be joined to the projectile by physically crimping the bullet-end component to the projectile or by brazing (e.g., furnace brazing, induction brazing, resistance brazing and hydrogen brazing); welding (e.g., electron beam welding, ultrasonic welding, laser welding, fusion welding, resistance welding (e.g., spot, seam, and flash welding), pressure welding and fusion welding); soldering; and bonding.

For example, the bullet-end component may be made of a first colored polymer while the middle body component may be made from a second colored polymer; the bullet-end component may be made of a colored polymer while the middle body component may be made from a metal; the bullet-end component may be made of a metal while the middle body component may be made from a colored polymer; the bullet-end component may be made of a colored polymer while the middle body component may be made from an alloy; the bullet-end component may be made of an alloy while the middle body component may be made from a colored polymer; or the bullet-end component may be made of a colored polymer while the middle body component may be made from the colored polymer.

The colored polymer may be a single colored polymer or multiple colored polymers. In addition, the colored polymer may include bands of color to further provide indicia to code the round.

For illustrative purposes only and not to limit the scope of the invention in any way: the bullet-end component may be made of a first colored polymer to denote the type of projectile, with red for incendiary projectiles, blue for tracer projectiles, green for armor piercing projectiles, yellow for explosive projectiles, and so forth. Similarly, the middle body component may be made of a first colored polymer to denote the type of projectile, with red for incendiary projectiles, blue for tracer projectiles, green for armor piercing projectiles, yellow for explosive projectiles, and so forth. In another embodiment, the ammunition may be further characterized using multiple combinations the bullet-end component having a first colored polymer to denote the type of projectile and the middle body component having a second colored polymer to denote the type of load.

In addition, the present invention provides indicia to identify the type of propellant load in a cartridge. For example, an ammunition may have a middle body component having a tan colored polymer to denote the normal load, a gray colored polymer to denote a subsonic load, a pink colored polymer to denote a substantially subsonic load of −70% of a normal load.

As result, the number of possible combinations are numerous. For example, the ammunition may have a red bullet-end component for incendiary projectiles and a metal middle body to denote a normal load; the ammunition may have a red bullet-end component for incendiary projectiles and a tan colored middle body to denote the normal load; the ammunition may have a red bullet-end component for incendiary projectiles and a gray colored middle body to denote a subsonic load; the ammunition may have a blue bullet-end component for tracer projectiles and a tan colored middle body to denote normal load; the ammunition may have a blue bullet-end component for tracer projectiles and a gray colored middle body to denote a subsonic load; the ammunition may have a yellow bullet-end component for explosive projectiles and a colored middle body to denote a subsonic load; and the ammunition may have a yellow bullet-end component for explosive projectiles and a tan colored middle body to denote normal load.

In these variations, the bullet-end component must be joined to the middle body component. This joining may be accomplished using a variety of methods in the art used to join similar and dissimilar materials. For example, the bullet-end component must be joined to the middle body component by brazing (e.g., furnace brazing, induction brazing, resistance brazing and hydrogen brazing); welding (e.g., electron beam welding, ultrasonic welding, laser welding, fusion welding, resistance welding (e.g., spot, seam, and flash welding), pressure welding and fusion welding); soldering; and adhesive bonding. In addition, the bullet-end component may be joined to the projectile by physically crimping the bullet-end component to the projectile or by brazing (e.g., furnace brazing, induction brazing, resistance brazing and hydrogen brazing); welding (e.g., electron beam welding, ultrasonic welding, laser welding, fusion welding, resistance welding (e.g., spot, seam, and flash welding), pressure welding and fusion welding); soldering; and bonding.

The polymeric and composite casing components may be injection molded. Polymeric materials for the bullet-end and middle body components must have propellant compatibility and resistance to gun cleaning solvents and grease, as well as resistance to chemical, biological and radiological agents. The polymeric materials must have a temperature resistance higher than the cook-off temperature of the propellant, typically about 320° F. The polymeric materials must have elongation-to-break values that to resist deformation under interior ballistic pressure as high as 60,000 psi in all environments (temperatures from about −65 to about 320° F. and humidity from 0 to 100% RH).

According to one embodiment, the middle body component is either molded onto or snap-fit to the casing head-end component after which the bullet-end component is snap-fit or interference fit to the middle body component. The components may be formed from high-strength polymer, composite or ceramic.

Examples of suitable high strength polymers include composite polymer material including a tungsten metal powder, nylon 6/6, nylon 6, and glass fibers; and a specific gravity in a range of 3-10. The tungsten metal powder may be 50%-96% of a weight of the bullet body. The polymer material also includes about 0.5-15%, preferably about 1-12%, and most preferably about 2-9% by weight, of nylon 6/6, about 0.5-15%, preferably about 1-12%, and most preferably about 2-9% by weight, of nylon 6, and about 0.5-15%, preferably about 1-12%, and most preferably about 2-9% by weight, of glass fibers. It is most suitable that each of these ingredients be included in amounts less than 10% by weight. The cartridge casing body may be made of a modified ZYTEL® resin, available from E.I. DuPont De Nemours Co., a modified 612 nylon resin, modified to increase elastic response. Examples of suitable polymers include polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, or urethane hybrids. Examples of suitable polymers also include aliphatic or aromatic polyamide, polyeitherimide, polysulfone, polyphenylsulfone, poly-phenylene oxide, liquid crystalline polymer and polyketone. Examples of suitable composites include polymers such as polyphenylsulfone reinforced with between about 30 and about 70 wt %, and preferably up to about 65 wt % of one or more reinforcing materials selected from glass fiber, ceramic fiber, carbon fiber, mineral fillers, organo nanoclay, or carbon nanotube. Preferred reinforcing materials, such as chopped surface-treated E-glass fibers provide flow characteristics at the above-described loadings comparable to unfilled polymers to provide a desirable combination of strength and flow characteristics that permit the molding of head-end components. Composite components can be formed by machining or injection molding. Finally, the cartridge case must retain sufficient joint strength at cook-off temperatures. More specifically, polymers suitable for molding of the projectile-end component have one or more of the following properties: Yield or tensile strength at −65° F.>10,000 psi Elongation-to-break at −65° F.>15% yield or tensile strength at 73° F.>8,000 psi Elongation-to-break at 73° F.>50% yield or tensile strength at 320° F.>4,000 psi Elongation-to-break at 320° F.>80%. Polymers suitable for molding of the middle-body component have one or more of the following properties: Yield or tensile strength at −65° F.>10,000 psi yield or tensile strength at 73° F.>8,000 psi yield or tensile strength at 320° F.>4,000 psi.

Commercially available polymers suitable for use in the present invention thus include polyphenylsulfones; copolymers of polyphenylsulfones with polyether-sulfones or polysulfones; copolymers and blends of polyphenylsulfones with polysiloxanes; poly(etherimide-siloxane); copolymers and blends of polyetherimides and polysiloxanes, and blends of polyetherimides and poly(etherimide-siloxane) copolymers; and the like. Particularly preferred are polyphenylsulfones and their copolymers with poly-sulfones or polysiloxane that have high tensile strength and elongation-to-break to sustain the deformation under high interior ballistic pressure. Such polymers are commercially available, for example, RADEL® R5800 polyphenylesulfone from Solvay Advanced Polymers. The polymer can be formulated with up to about 10-15 wt % of one or more additives selected from internal mold release agents, heat stabilizers, anti-static agents, colorants, impact modifiers and UV stabilizers.

The polymers of the present invention can also be used for conventional one, two and three piece plastic-plastic or metal-plastic hybrid cartridge case designs and conventional designs. One example of such a design is an ammunition cartridge with a one-piece substantially cylindrical polymeric cartridge casing body with an open projectile-end and an end opposing the projectile-end with a male or female coupling element; and a cylindrical metal cartridge casing head-end component with an essentially closed base end with a primer hole opposite an open end having a coupling element that is a mate for the coupling element on the opposing end of the polymeric cartridge casing body joining the open end of the head-end component to the opposing end of the polymeric cartridge casing body. The high polymer ductility permits the casing to resist breakage.

One embodiment includes a 2 cavity prototype mold having an upper portion and a base portion for a 5.56 case having a metal insert over-molded with a Nylon 6 (polymer) based material. In this embodiment, the polymer in the base includes a lip or flange to extract the case from the weapon. One 2-cavity prototype mold to produce the upper portion of the 5.56 case can be made using a stripper plate tool using an Osco hot spur and two subgates per cavity. Another embodiment includes a subsonic version, the difference from the standard and the subsonic version is the walls are thicker, thus requiring less powder. This will decrease the velocity of the bullet, thus creating a subsonic round.

The extracting inserts are used to give the polymer case a tough enough ridge and groove for the weapons extractor to grab and pull the case out from the chamber of the gun. The extracting insert is made of 17-4 ss that is hardened to 42-45 rc. The insert may be made of aluminum, brass, cooper, steel, or even an engineered resin with enough tensile strength.

The insert is over molded in an injection molded process using a nano clay particle filled Nylon material. The inserts can be machined or stamped. In addition, an engineered resin able to withstand the demand on the insert allows injection molded and/or even transfer molded. The insert may also be over molded in an injection molded process using a fiber-reinforced polymeric composite material. The fiber-reinforced polymeric composite may contain between about 2 wt %, 2.1 wt %, 2.25 wt %, 2.5 wt %, 2.75 wt %, 3.0 wt %, 3.25 wt %, 3.5 wt %, 3.75 wt %, 4.0 wt %, 4.25 wt %, 4.5 wt %, 4.75 wt %, 5.0 wt %, 5.25 wt %, 5.5 wt %, 5.75 wt %, 6.0 wt %, 6.25 wt %, 6.5 wt %, 6.75 wt %, 7.0 wt %, 7.25 wt %, 7.5 wt %, 7.75 wt %, 8.0 wt %, 8.25 wt %, 8.5 wt %, 8.75 wt %, 9.0 wt %, 9.25 wt %, 9.5 wt %, 9.75 wt %, 10 wt %, 11 wt %, 12 wt %, 13 wt %, 14 wt %, 15 wt %, 16 wt %, 17 wt %, 18 wt %, 19 wt %, 20 wt %, 21 wt %, 22 wt %, 23 wt %, 24 wt %, 25 wt %, 26 wt %, 27 wt %, 28 wt %, 29 wt %, 30 wt %, 31 wt %, 32 wt %, 33 wt %, 34 wt %, 35 wt %, 36 wt %, 37 wt %, 38 wt %, 39 wt %, 40 wt %, 41 wt %, 42 wt %, 43 wt %, 44 wt %, 45 wt %, 46 wt %, 47 wt %, 48 wt %, 49 wt %, 50 wt %, 51 wt %, 52 wt %, 53 wt %, 54 wt %, 55 wt %, 56 wt %, 57 wt %, 58 wt %, 59 wt %, 60 wt %, 61 wt %, 62 wt %, 63 wt %, 64 wt %, 65 wt %, 66 wt %, 67 wt %, 68 wt %, 69 wt %, 70 wt % fiber fillers and incremental variations thereof. The fiber fillers may be glass fiber fillers, mineral fillers, polymer fillers or mixtures thereof.

Suitable polymer materials can include polybutylene terephthalate (PBT), polycarbonate (PC), polyvinyl butyral (PVB), polyvinyl alcohol (PVA), polyvinyl acetate (PVAc), polyurethane (PU), polyureas, polycyclic olefin copolymer (COC), polymethyl methacrylate (PMMA), polyethyl methacyrlate (PEMA), acrylate copolymers, polyvinylidine fluoride (PVDF), polyimides, copolymers of the afore-mentioned, and mixture thereof. Suitable solvents can include dimethylacetamide (DMAc), water, toluene, benzene, xylene, mesitylene, ethylbenzene, dimethylsulfoxide (DMSO), diethylsulfoxide, N,N-dimethylformamide (DMF), N,N-diethylformamide, N,N-diethylacetamide, N-methyl-2-pyrrolidone (NMP), N-cyclohexyl-2-pyrrolidone, 1,3-dimethyl-2-imidazolidinone, diethyleneglycol dimethoxyether, o-dichlorobenzene, dichloromethane, chloroform, phenols, cresols, xylenol, catechol, butyrolactones, hexamethylphosphoramide, acetone, methyl ethyl ketone, methyl ethyl ketone, methyl isobutyl ketone, cyclopentanone, acetyl acetone, tetrahydrofuran, 1,4-dioxane, and mixtures thereof.

The present invention includes polymer compositions that include one or more pigments or organic molecules that produce a color. The pigment may be selected from among carbon black, any organic pigment related to a class of azo or azo condensed pigments, metal complexes, benzimidazolones, azomethines, methines, cyanines, azacarbocyanines, enamines, hemicyanines, streptocyanines, styryls, zeromethines, mono-, di-, tri-, and tetraazamethines, caratenoids, arylmethanes, diarylmethanes, triarylmethanes, xanthenes, thioxanthenes, flavanoids, stilbenes, coumarins, acridenes, fluorenes, fluorones, benzodifuranones, formazans, pyrazoles, thiazoles, azines, diazines, oxazines, dioxazines, triphenodioxazines, phenazines, thiazins, oxazones, indamines, nitroso, nitro, quinones, hydroquinones, naphthaquinones, anthraquinones, rhodamines, phthalocyanines, neutrocyanines, diazahemicyanines, porphirines, perinones, perylenes, pyronins, diketopyrrolopyrroles, indigo, indigoids, thioindigo, indophenols, naphthalimides, isoindolines, isoindolinones, iminoisoindolines, iminoisoindolinones, quinacridones, flavanthrones, indanthrones, anthrapyrimidines, quinophthalones, isoviolanthrones, pyranthrones, titanium dioxide, zinc oxide, chromium oxide (green, brown, etc.), silica, iron oxide (yellow, red, black, brown, or a combination or mixture thereof), antimony yellow, lead chromate, lead chromate sulfate, lead molybdate, ultramarine blue, cobalt blue, manganese blue, chrome oxide green, hydrated chrome oxide green, cobalt green, metal sulfides, cadmium sulfoselenides, zinc ferrite, bismuth vanadate, and derivatives, C.I. Pigment Black 1, 2, 3, 6, 7, 9, 11, 12, 14, 15, 22, 26, 27, 28, 29, 30, 31, 32, 33, 34 and 35; C.I. Pigment Green 7, 18, 20, 21, 22, 36, 37, 47, 54, and 58; C.I. Pigment Blue 15:1, 15:2, 15:3, 15:4, 15:6, 16, 21, 22, 25, 27, 30, 60, 64, 65, 73, 75, 76, and 79; 60, 64, 65, 75, 76, and 79; C.I. Pigment Red 12, 13, 14, 15, 21, 23, 32, 40, 85, 88, 89, 112, 114, 122, 123, 144, 147, 149, 166, 168, 170, 171, 175, 176, 177, 178, 179, 180, 181, 183, 184, 185, 187, 188, 189, 190, 192, 194, 195, 196, 202, 208, 209, 214, 216, 220, 221, 224, 226, 242, 245, 248, 251, 254, 255, 256, 260, 264, 265, 266, 269, 271 and 275; C.I. Pigment Orange 2, 3, 4, 5, 16, 22, 24, 36, 38, 40, 43, 51, 60, 61, 62, 64, 66, 69, 71, 72, 73, and 77; C.I. Pigment Yellow 38, 40, 53, 119, 157, 158, 160, 161, 162, and 184; C.I. Pigment White 4, 5, 6, 6:1, 7, 8, 9, 10, 12, 13, 14, 15, 18, 18:1, 19, 21, 22, 23, 24, 25, 26, 27, 28, 32, 33, and 36; C.I. Vat Black 1, 2, 7, 8, 25, 27, 28, 29, 30, 35, 65; C.I. Vat Green 1, 2, 3, 4, 6, 8, 9, 11, 12, 17, 23; C.I. Vat Blue 1, 2, 3, 4, 5, 6, 7, 8, 9, 11, 12, 13, 14, 16, 18, 19, 20, 21, 22, 25, 30, 31, 32, 33, 37, 40, 42, 43, 47, 53, 64, and 67; C.I. Vat Violet 1, 2, 3, 4, 5, 8, 9, 10, 13, 14, 15, 16, 17, 18, and 19; C.I. Vat Brown 1, 3, 5, 8, 9, 14, 16, 21, 22, 25, 26, 31, 33, 37, 42, and 45; C.I. Vat Red 10, 13, 14, 15, 18, 19, 20, 21, 23, 24, 28, 29, 32, 35, 37, 38, 39, 40, 42, 44, and 48; C. I. Vat Orange 1, 2, 3, 4, 7, 9, 11, 13, 15, 16, 17, 18, 19, and 20; C. I. Vat Yellow 1, 2, 3, 4, 9, 10, 11, 12, 13, 17, 18, 20, 23, 26, 27, 28, 29, 31, 33, and 44; and any combination thereof, and wherein the pigment comprises a vat or disperse dye or insoluble salt or complex of acid, direct, reactive, mordant, solvent, natural, basic (cationic), sulfur, fluorescent, or optical brightener, a mixture of organic pigment, inorganic pigment or extenders or solid solutions thereof, shell type pigments with inorganic nuclei covered with organic shell, or dispersed polymer particles or any combination thereof. Other examples include, quinacridones, such as PR122, PR202, PR207, PR209, PV19, and their solid solutions; phthalocyanines, such as PB15:1, PB15:2, PB15:3, PB15:4, PB15:6, PB16, PG7, PG36, and PG37; azo such as PY74, PY83; disazo, such as PY93, PY95, PY155, PY158, PY166, PR144, PR220, and PR221; metal complexes such as PY117, PY150, PY153; benzimidazolones such as PY120, PY151, PY154, PY156, PY175, PY180, PY181, PY194, PR171, PR175, PR176, PR185, PR208, PO36, PO60, PO62, PO64, PO72, PV32; diketopyrrolopyrroles such as, PR254, PR255, PR264, PR272, PO71, PO73; dioxazines such as PV23 and PV37; isoindolenones such as PY109, PY110, PY139, PY173, PY185, PO61, PO180; isoindolines such as PY139 and PY185; anthraquinones such as PY99, PY108, PY123, PY147, PY193, PR43, PR83, PR89, PR177 and PR196; indanthrones such as PB60 and PB64; flavanthrones, such as PY24; perylene such as PR123, PR178; PR179; PR190, PR224, PB31, and PB32; pyranthrone PR226; violanthrone PB65; and carbon black such as PB7. Non-limiting examples of suitable pigments include azo or azo condensed pigments, metal complexes, benzimidazolones, azomethines, methines such as cyanines, azacarbocyanines, enamines, hemicyanines, streptocyanines, styryls, zeromethines, mono-, di-, tri-, and tetraazamethine; caratenoids, arylmethanes such as diarylmethanes and triarylmethanes; xanthenes, thioxanthenes, flavanoids, stilbenes, coumarins, acridenes, fluorenes, fluorones, benzodifuranones, formazans, pyrazoles, thiazoles, azines, diazines, oxazines, dioxazines, triphenodioxazines, phenazines, thiazines, oxazones, indamines, nitroso, nitro, quinones such as hydroquinones, naphthaquinones, and anthraquinones; rhodamines, phthalocyanines, neutrocyanines, diazahemicyanines, porphirines, perinones, perylenes, pyronins, diketopyrrolopyrroles, indigo, indigoids, thioindigo, indophenols, naphthalimides, isoindolines, isoindolinones, iminoisoindolines, iminoisoindolinones, quinacridones, flavanthrones, indanthrones, anthrapyrimidines, quinophthalones, isoviolanthrones, pyranthrones, and any combinations and/or any solid solution thereof; vat or disperse dyes or insoluble salt/complex of acid, direct, reactive, mordant, solvent, natural, basic (cationic), sulfur, fluorescent, or optical brightener; mixtures of organic, inorganic pigments or extenders, solid solutions thereof, shell type pigments with inorganic nuclei covered with organic shell. The pigment also can be a dispersed polymer particle, such as polystyrene, polyamides, polysulfones, polyesters, polyurethanes, polyalkylenes, polysulfides, co-polymers and mixtures or co-polymers thereof, but not limited by them only. The dispersed polymer particles can be non-colored or colored with any of the aforementioned pigments and/or dyes.

Non-limiting examples of inorganic pigments include carbon black, titanium dioxide, zinc oxide, silica, iron oxide, antimony yellow, lead chromate, lead chromate sulfate, lead molybdate, ultramarine blue, cobalt blue, manganese blue, chrome oxide green, hydrated chrome oxide green, cobalt green, metal sulfides, cadmium sulfoselenides, zinc ferrite, bismuth vanadate, and derivatives and any combinations thereof.

In the dispersions provided herein, the surface modified pigment of the invention can be present in an amount at or about 0.001 wt % to at or about 60 wt %, or at or about 2 wt % to at or about 50 wt %, or at or about 3 wt % to at or about 40 wt %, or at or about 5 wt % to at or about 30 wt % based on the weight of the dispersion. Pigment concentrations below 1% are possible but are not economical to mill. Pigment concentrations above 60% are possible but typically will not provide acceptable rheological behavior. In some instance, the surface modified pigment is present in an amount of 0.001 wt %, 0.01 wt %, 0.1 wt %, 1 wt %, 2 wt %, 3 wt %, 4 wt %, 5 wt %, 6 wt %, 7 wt %, 8 wt %, 9 wt %, 10 wt %, 11 wt %, 12 wt %, 13 wt %, 14 wt %, 15 wt %, 16 wt %, 17 wt %, 18 wt %, 19 wt %, 20 wt %, 21 wt %, 22 wt %, 23 wt %, 24 wt %, 25 wt %, 26 wt %, 27 wt %, 28 wt %, 29 wt %, 30 wt %, 31 wt %, 32 wt %, 33 wt %, 34 wt %, 35 wt %, 36 wt %, 37 wt %, 38 wt %, 39 wt %, 40 wt %, 41 wt %, 42 wt %, 43 wt %, 44 wt %, 45 wt %, 46 wt %, 47 wt %, 48 wt %, 49 wt %, 50 wt %, 51 wt %, 52 wt %, 53 wt %, 54 wt %, 55 wt %, 56 wt %, 57 wt %, 58 wt % or 60 wt %, based on the weight of the dispersion and more specifically 0.001 wt %, 0.01 wt %, 0.1 wt %, 0.25 wt %, 0.5 wt %, 0.75 wt %, 1 wt %, 2 wt %, 2.1 wt %, 2.25 wt %, 2.5 wt %, 2.75 wt %, 3.1 wt %, 3.25 wt %, 3.5 wt %, 3.75 wt %, 4.0 wt %, 4.25 wt %, 4.5 wt %, 4.75 wt %, 5.0 wt %, 5.25 wt %, 5.5 wt %, 5.75 wt %, 6.0 wt %, 6.25 wt %, 6.5 wt %, 6.75 wt %, 7.0 wt %, 7.25 wt %, 7.5 wt %, 7.75 wt %, 8.0 wt %, 8.25 wt %, 8.5 wt %, 8.75 wt %, 9.0 wt %, 9.25 wt %, 9.5 wt %, 9.75 wt %, 10.0 wt % and incremental variations thereof. One of ordinary skill in the art will know that many propellant types and weights can be used to prepare workable ammunition and that such loads may be determined by a careful trial including initial low quantity loading of a given propellant and the well known stepwise increasing of a given propellant loading until a maximum acceptable load is achieved. Extreme care and caution is advised in evaluating new loads. The propellants available have various burn rates and must be carefully chosen so that a safe load is devised.

The pigment may be incorporated into a polymer that is added to the polymer composition used to form a copolymer used to form a polymeric bullet-end upper portion comprising a first polymer composition and/or a polymeric middle body comprising a second polymer composition. The first polymer composition may be a copolymer of the polymer and a polymer having a pigment incorporated therein. Similarly, the second polymer composition may be a copolymer of the polymer and a polymer having a pigment incorporated therein. Also, both the first polymer composition may be a copolymer of the polymer and a polymer having a pigment incorporated therein and the second polymer composition may be a copolymer of the polymer and a polymer having a pigment incorporated therein.

In addition the present invention also includes a coating applied to the ammunition cartridge and more specifically to the bullet-end upper portion, the middle body or both. The coating may be a pigment incorporated into a polymer that is used for indicia rather than for structural support. As a result, the thickness may be thin from microns to millimeters and all thicknesses there between. Similarly the concentration of the pigment or dye may be up to 75 weight percent as it is solely used for color indicia. The polymer used may be any polymer that will adhere to the ammunition cartridge and more specifically to the bullet-end upper portion, the middle body or both and may be a single polymer or a mixture of copolymers.

The description of the preferred embodiments should be taken as illustrating, rather than as limiting, the present invention as defined by the claims. As will be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

The invention claimed is:

1. A method of making color coded polymer ammunition cartridges comprising the steps of:

providing a polymer ammunition cartridges comprising a primer insert comprising a top surface opposite a bottom surface and an coupling element that extends from the bottom surface, a primer recess in the top surface that extends toward the bottom surface, a flash hole aperture positioned in the primer recess to extend through the bottom surface, and a flash aperture groove in the primer recess that extends circumferentially about the flash hole aperture;

a mid-body comprising a second polymer composition having a nose coupler at one end extending to an overmolded primer insert, wherein the second polymer composition extends over the coupling element and into the flash hole aperture to the flash aperture groove to form an overmolded flash hole;

a nose connected to the coupling element wherein the nose comprises a first polymer composition, wherein the nose comprises a mid-body coupling element connected to a projectile end aperture to engage a projectile by a shoulder;

providing a first colorant in the first polymer composition; and providing at least a second colorant in the second polymer composition.

2. The method of claim 1, wherein the first colorant comprises one or more pigments selected from black pigments, white pigments, gray pigments, pink pigments, red pigments, orange pigments, yellow pigments, green pigments, cyan pigments, blue pigments, violet pigments, purple pigments, brown pigments, tan pigments, brass pigments, copper pigments, or gold pigments.

3. The method of claim 1, wherein the at least a second colorant comprises one or more pigments selected from black pigments, white pigments, gray pigments, pink pigments, red pigments, orange pigments, yellow pigments, green pigments, cyan pigments, blue pigments, violet pigments, purple pigments, brown pigments, tan pigments, brass pigments, copper pigments, or gold pigments.

4. The method of claim 1, wherein the first colorant comprises one or more first pigments selected from black pigments, white pigments, gray pigments, pink pigments, red pigments, orange pigments, yellow pigments, green pigments, cyan pigments, blue pigments, violet pigments, purple pigments, brown pigments, tan pigments, brass pigments, copper pigments, or gold pigments and the at least a second colorant comprises one or more second pigments selected from black pigments, white pigments, gray pigments, pink pigments, red pigments, orange pigments, yellow pigments, green pigments, cyan pigments, blue pigments, violet pigments, purple pigments, brown pigments, tan pigments, brass pigments, copper pigments, or gold pigments.

5. The method of claim 1, wherein the first colorant comprises one or more first dye selected from black dye, white dye, gray dye, pink dye, red dye, orange dye, yellow dye, green dye, cyan dye, blue dye, violet dye, purple dye, brown dye, tan dye, brass dye, copper dye, or gold dye and the at least a second colorant comprises one or more second dyes selected from black dye, white dye, gray dye, pink dye, red dye, orange dye, yellow dye, green dye, cyan dye, blue dye, violet dye, purple dye, brown dye, tan dye, brass dye, copper dye, or gold dye.

6. The method of claim 1, wherein the first colorant, the at least a second colorants or both are present in an amount of between 0.001 and 10 wt % and more specifically 0.001 wt %, 0.01 wt %, 0.1 wt %, 0.25 wt %, 0.5 wt %, 0.75 wt %, 1 wt %, 2 wt %, 2.1 wt %, 2.25 wt %, 2.5 wt %, 2.75 wt %, 3.1 wt %, 3.25 wt %, 3.5 wt %, 3.75 wt %, 4.0 wt %, 4.25 wt %, 4.5 wt %, 4.75 wt %, 5.0 wt %, 5.25 wt %, 5.5 wt %, 5.75 wt %, 6.0 wt %, 6.25 wt %, 6.5 wt %, 6.75 wt %, 7.0 wt %, 7.25 wt %, 7.5 wt %, 7.75 wt %, 8.0 wt %, 8.25 wt %, 8.5 wt %, 8.75 wt %, 9.0 wt %, 9.25 wt %, 9.5 wt %, 9.75 wt %, 10.0 wt % and incremental variations thereof.

7. The method of claim 1, wherein the first colorant and the second colorant are different colorant.

8. The method of claim 1, wherein the first polymer composition, the second polymer composition or both comprise polybutylene terephthalate, polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly (etherimide-siloxane) copolymers, blends of polyetherimides and polysiloxanes, and blends of polyetherimides and poly(etherimide-siloxane) copolymers.

9. The method of claim 1, wherein the polymeric bullet-end upper portion, the polymeric middle body or both comprise a nylon polymer or a polycarbonate polymer.

10. The method of claim 1, wherein the fiber-reinforced polymeric composite contains between about 3 and about 50 wt % glass fiber fillers, mineral fillers, or mixtures thereof.

11. The method of claim 1, wherein the color coded polymeric ammunition cartridge is an ammunition cartridge adapted to receive a projectile having a diameter of 5.56 mm, 7.62 mm, 0.338 inch, 0.338 inch, 0.510 inch, 0.45 inch, 0.355 inch, 0.357 inch, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm, 460 mm, 8 inch, or 4.2 inch.

12. The method of claim 1, wherein the first colorant and the at least a second colorant comprise brown pigments.

13. The method of claim 1, wherein the first colorant or the at least a second colorant comprise a brown pigment.

14. The method of claim 1, wherein the first colorant, the at least a second colorant or both comprise green pigments.

15. The method of claim 1, wherein the first colorant or the at least a second colorant comprise green pigments.

16. The method of claim 1, wherein the first polymer composition, the second polymer composition or both comprise one or more green pigments and one or more brown pigments.

17. The method of claim 1, wherein the first colorants and the at least a second colorant are the same pigment and the pigment correlates to a first feature of the color coded polymeric ammunition, wherein the first feature is selected from propellant load, projectile type, projectile shape, projectile use, or a combination thereof.

18. The method of claim 1, wherein the first colorants and the at least a second colorant are the different pigments and the first colorants correlates to a first feature of the color coded polymeric ammunition, and the at least a second colorant correlates to a second feature of the color coded polymeric ammunition, wherein the first feature and second feature are independently selected from propellant load, projectile type, projectile shape, projectile use, or a combination thereof.

19. The method of claim 1, wherein the first colorants and the at least a second colorant correlate to an indicia to form the color coded polymeric ammunition.

* * * * *